343-754 SR
3/27/79 OR 4,146,895

United States Patent [19] [11] 4,146,895
Wild [45] Mar. 27, 1979

[54] GEODESIC LENS AERIAL

[75] Inventor: John P. Wild, Strathfield, Australia

[73] Assignee: Commonwealth Scientific and Industrial Research Organization, Campbell, Australia

[21] Appl. No.: 745,701

[22] Filed: Nov. 29, 1976

[30] Foreign Application Priority Data

Nov. 28, 1975 [AU] Australia ..... 4106/75

[51] Int. Cl.[2] ..... H01Q 19/06; H01Q 13/10; H01Q 15/02

[52] U.S. Cl. ..... 343/754; 343/767; 343/909

[58] Field of Search ..... 343/754, 755, 767, 768, 343/909

[56] References Cited

U.S. PATENT DOCUMENTS

| | | | |
|---|---|---|---|
| 3,343,171 | 9/1967 | Goodman, Jr. | 343/754 |
| 3,392,394 | 7/1968 | Caballero, Jr. | 343/754 |
| 3,508,275 | 4/1970 | Deveau et al. | 343/768 |
| 3,916,415 | 10/1975 | Howery | 343/768 |
| 3,921,176 | 11/1975 | Shanafelt | 343/754 |
| 3,964,069 | 6/1976 | McDonough | 343/754 |

OTHER PUBLICATIONS

Richard C. Johnson, The Geodesic Luneberg Lens, in The Microwave Journal, Aug. 1962.

*Primary Examiner*—Alfred E. Smith
*Assistant Examiner*—Harry E. Barlow
*Attorney, Agent, or Firm*—Sughrue, Rothwell, Mion, Zinn and Macpeak

[57] ABSTRACT

A parallel plate geodesic lens aerial in the shape of a spherical cap or a flat disc, generates scanned planar radio beams. Commutated input signals to the lens are fed via output probes located around an arc of the perimeter of the lens to an arcuate array of radiating elements. The positional relationship between the power output from the lens and the power input to the array is 1:k, where k $\neq$ 1. Dielectric-filled geodesic lenses, power level and scanned beam accuracy monitoring, and complex modulation of the input power to enable simpler aerials to be realized, are described.

7 Claims, 4 Drawing Figures

GEODESIC LENS AERIAL

This invention concerns aerial structures formed by commutatively switched geodesic lens microwave feed systems connected to radiating arrays for the generation of scanned radio beams. In particular, it concerns a spherical or flat geodesic lens feed system and the aerial structure formed by connecting such a feed system to its associated radiating array with linear relation between angular positions of the output elements of the lens and the array elements.

BRIEF DESCRIPTION OF THE DRAWINGS

In the following discussion of the background to the present invention and in the later description of embodiments of it, reference will be made to the accompanying drawings, in which FIG. 4 is a block diagram of a complex modulation system for reducing sidelobe levels in an aerial according to the present invention.

Geodesic lens aerial arrangements are known per se. As long ago as 1948, R. F. Rinehart, in a paper published in the *Journal of Applied Physics* (Volume 19, pages 860–862), showed that a surface of revolution for the lenses could be devised which satisfied the requirement to produce a radiated wavefront as near plane as possible, that no aberration of the signal should be introduced by the lens. Such a surface of revolution is incorporated into the known geodesic "tin hat" lens, which has been described by R. C. Johnson in his paper entitled "Geodesic Luneberg Lens" in "Microwave Journal" Vol. 5, page 76, April 1962. The construction of a lens having such a complex surface, however, is not a simple manufacturing operation. The present invention, enables aerial structures with acceptable performance to be constructed more easily and economically than "tin hat" lens aerials, whilst its geometrical simplicity enables a variety of designs to be made to suit different requirements.

Figure 1:
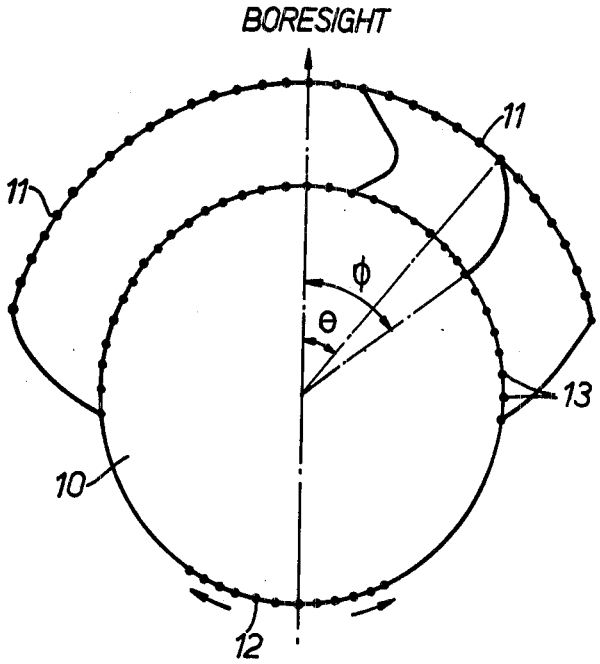
FIG. 1 is a schematic representation of a geodesic lens aerial with various parameters used in mathematical consideration of the aerial appropriately referenced.

Column radiators or curved arrays of column radiators forming the radiating structures of the type to which the present invention relates are described in the specification of my copending U.S. application Ser. No. 694,128 entitled "Radiators For Microwave Aerials." In the aerial structures (which include concave and convex radiating arrays) referred to in that specification, the parallel plate circularly symmetrical feed system is in each case connected to its radiating array so that the positional angle $\phi$ of an output probe of the lens is equal to the positional angle $\theta$ of an array element (see FIG. 1). It has now been found that if this 1:1 relationship is not maintained, but a linear angle transformation factor of 1:k is applied between the output probe and array element angles, a reduced size aerial structure and/or a reduction in the aberration of the radiating signal may be obtained, provided the value of the transformation factor k is less than 1 and is chosen to be appropriate for the array diameter and scan coverage required.

Basically, according to the present invention, a scanning beam aerial system comprises:

(a) a parallel plate, geodesic lens microwave feed system having arcuate arrays of input and output probes located around the edge of the geodesic lens, (b) a circular or arcuate array of radiating elements, and (c) means connecting the output power from said lens output probes to said radiating array by a linear angular transformation 1:k, where $k \neq 1$.

Typically, the geodesic lens will be a spherical cap geodesic lens, that is, it will be formed from two circularly symmetrical parallel conducting plates each in the shape of a spherical cap. In the geometrically extreme (but practical) case, the lens can be a flat disc (i.e., the radius of the sphere is infinite). In both the spherical cap and flat disc geodesic lens systems, an arc of input probes is located on one side of the lens and an arc of output probes is located on the other side of the lens. Power is connected (using, for example, RF cables) from the output probes of the lens to the radiating array of the aerial, which is typically an assembly of column radiators — for example, slotted- waveguides or dipole arrays.

Commutative excitation of the input probes, or an arc of these probes, will result in the production of a scanned beam of radiation from the radiating array.

Filling the space between the parallel plates of the lens with dielectric material enables a smaller lens to be constructed.

Figure 2:
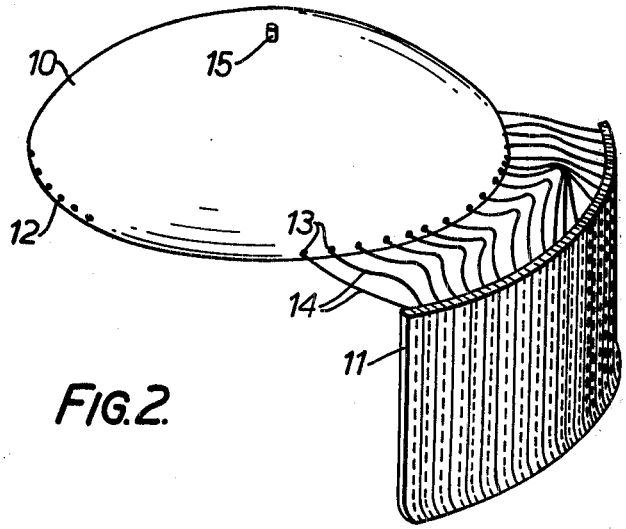
FIG. 2 is a perspective sketch of one embodiment of an aerial incorporating the present invention.

An embodiment of the present invention as it may be applied to a ground based aerial which is used to generate planar microwave scanning beams is illustrated schematically in FIG. 2.

This illustrated embodiment comprises a spherical cap, parallel plate, geodesic lens 10, supplied with power through input probes 12 arranged in an arc on one side of the lens. The arc of input probes 12 extends over an angle slightly greater than that required for the specific angular scan range of the aerial. An arc of output probes 13 on the opposite side of lens 10, are connected by equal-length cables 14 to an array of radiating columns 11. The assemblage of column radiators (e.g., slotted-waveguide or dipole arrays) can be designed to radiate planar beams with a sharp cut-off at low elevation angles and a desired power distribution over higher elevation angles. The arc of output probes 13 can extend almost up to the arc of input probes 12.

Scanning of the beam produced by this aerial structure is effected by a commutated system of excitation applied to the arc of input probes 12.

With a lens diameter of about 4.5 meters, a high quality 1° beam, at C-band microwave frequencies, can be produced which scans over angles of ±40° without beam deterioration at the scan extremes.

If the radius of the small circle bounding the spherical cap of lens 10 is greater than that of the arc of the array of radiators, the lens can form a roof for the whole aerial structure with the commutating electronics housed inside. Alternatively, if it is smaller, the lens can be housed inside the walls formed by the radiators. In either case the radiating structure can be enclosed within a transparent radome surface which is heated to prevent the formation of ice. The lower end of the column radiators may be raised above ground level to a height sufficient to prevent obstruction by formation of snow-banks and/or to ensure reception of signals by an aircraft at all elevations when landing (e.g. when the aerial structure is used in a microwave landing system at an airport with slightly humped runways).

When the total angle to be scanned using the aerial structure is less than ±55° the overall size of the aerial structure may be smaller than a comparable structure with a 1:1 angular transformation between lens and array, as will be shown later in this specification.

Monitoring the feed power of this type of aerial structure can readily be carried out, with the aid of a central pick-up probe 15 located in the dome of the lens. Deviations from constant amplitude and phase picked up by the probe will indicate a fault in the commutation system.

Beam accuracy monitoring can be implemented using a parallel plate annular lens having an inner radius substantially half that of the geodesic lens, loosely coupled at its outer circumference to the geodesic lens. In my aforementioned copending application Ser. No. 694,128, at pages 6–7 thereof, a technique for monitoring the accuracy of a concave aerial is described whereby the signal in the aerial is sampled at various points and, the sampled signals are added without phase change and the resulting signal is compared in the phase comparator with a signal from the transmitter. As the effective center of the radiating aperture moves, the vector representing the sum of the individual signals rotates and provides an accurate indication of the beam direction. By placing an annular lens within the geodesic lens and coupling the former to the latter at least in the vicinity of the output probes, an image of the input excitation to the geodesic lens will be formed at the inner circumference of the annular lens and this image may be sampled to indicate beam direction.

To understand how the angular transformation value "k" is selected, it is helpful to consider some mathematical aspects of the aerial arrangement.

The path length from an input probe to a point on the plane wavefront radiated by the array can be expressed as a function $P(\theta)$ of the array position angle $\theta$. One basic method used by the present inventor in designing parallel plate geodesic lenses to match circular or arcuate arrays is to write down the equation for the differential path length for any point on the wavefront compared with the central point, $P(\theta) - P(o)$ which may be expressed as a polynomial in $\theta$, namely $$P(\theta) - P(o) = \alpha\theta^2 + \beta\theta^2 + \ldots, \quad (1)$$

and to determine the conditions under which the coefficient $\alpha$ and, if possible, the coefficient $\beta$, vanish. This provides an initial solution which is a first approximation for minimum cylindrical aberration. Further analysis, or trial and error, may then be used to derive an improved or optimised solution.

If the plates of the lens are filled with dielectric material of refractive index n, $P(\theta)$ has the form $$P(\theta) = nf(\theta) \pm \cos\theta \quad (2)$$

where the radiating array is of unit radius and the ± sign is chosen according as the array is to radiate inwards or outwards. From Taylor's theorem, $$\alpha = \frac{1}{2!} \cdot P''(o) \quad (3)$$

and $$\beta = \frac{1}{4!} \cdot P''''(o) \quad (4)$$

where the primes denote differentiations with respect to $\theta$. Hence to satisfy (3), (4) with (2), $$nf''(o) = \pm 1 \quad (5)$$

$$nf''''(o) = \pm 1 \quad (6)$$

The output of a circularly symmetrical lens feed system has (except in the R-2R lens, as shown below) hitherto always been connected to the radiating array in such a way that the position angle $\phi$ on the lens is equal to the position angle $\theta$ on the array. If this 1:1 relationship is no longer maintained, and instead a linear transformation 1:k is applied between lens and array angles, for the case when n = 1, equation (2) becomes $$P(\theta) = f(\theta/k) \pm \cos\theta, \quad (2')$$

whilst equations (5) and (6) become $$(1/k2) \cdot f''(o) = \pm 1 \quad (5')$$

and $$(1/k4) \cdot f''''(o) = \pm 1 \quad (6')$$

Comparing equations (5) and (5') shows that applying the angle transformation factor k has a similar effect to filling the parallel plates of the lens with a dielectric material of refractive index $1/k2$. A comparison of equations (6) and (6'), however, shows that the effects are not identical. What is clear, though, is that if $k<1$, it is possible to reduce the size of the lens for a given aerial performance (i.e. no increase in aberration).

To obtain the minimum value of k, initial solutions for specific coverage angles, $\theta_c$ with given aerial apertures are first obtained. If it is assumed that for one direction the useful aperture subtends an angle of ± 70° at the centre, the minimum value of k, with no diplexing of lens probes, is given by $$k = \frac{2\theta_c + 70°}{180°}. \quad (7)$$

Note that when k = 1, $\theta_c$ = 55°, thus for coverage angles less than ± 55°, a reduction in aerial size is possible by using the appropriate value of k.

If, in the case of a spherical lens arrangement illustrated in FIG. 2, the radii of the sphere, lens and array are, respectively, a, b and l, then $P(\theta)$ is given by equation (2'), choosing the lower sign for outward radiation, with $$f\left(\frac{\theta}{k}\right) = 2a \sin^{-1}\left\{\frac{b}{a}\cos\frac{\theta}{2k}\right\}, \quad (2'')$$

Equations (5') and (6') are satisfied if $$\frac{1}{b^2} = \frac{1}{a^2} + \frac{1}{4k^2} \quad (5'')$$

and $$k^4 = \frac{b}{8}\left[\frac{1 + 2(\frac{b}{a})^2}{\{1 - (\frac{b}{a})^2\}^{3/2}}\right], \quad (6'')$$

respectively. Solving these equations gives $$a = \frac{2\sqrt{3 \cdot k^2}}{\sqrt{(4k^2 - 1)}} \quad (8)$$

and $$b = \frac{\sqrt{6 \cdot k^2}}{\sqrt{(2k^2 + 1)}} \quad (9)$$

The initial solutions (with the aid of equation (7)) are given in the following table for differing values of $\theta_c$:

| $\theta_c$ | k | a | b |
|---|---|---|---|
| 55° | 1.000 | 2.000 | 1.414 |
| 40° | 0.833 | 1.804 | 1.101 |
| 30° | 0.722 | 1.733 | 0.894 |
| 20° | 0.611 | 1.841 | 0.692 |
| 10° | 0.500 | ∞ | 0.500 |

Of note is the last set of values in this table, which refer to a flat lens, known as the "R-2R" lens. In the more general flat disc lens case, the lens function is $$f(\frac{\theta}{k}) = 2b \cdot \cos(\frac{\theta}{2k})$$

and $$P(\theta) = 2b \cdot \cos(\frac{\theta}{2k}) - \cos\theta. \quad (2''')$$

Without dielectric between the plates of the flat disc lens, it can be shown that (using the same notation as above) acceptable aberration can be obtained with $$b = 2k^2$$

when $$\beta = \frac{1}{24}(\frac{1}{4k^2} - 1).$$

In the case of a flat lens with k = 1, the radii of the lens and the array may be made equal if dielectric material of refractive index 2 is used between the plates of the feed system. Similarly, with n = 4, the lens radius can be made half the radius of the array. If the linear transformation k = ½ is used, the same result is achieved, but with k = ½, the aberration becomes zero — i.e. the lens aberration vanishes — but the useful coverage angle is only ± 10°.

To determine some optimum designs for the spherical geodesic lens situation, equation (5'') is maintained while the variables are allowed to depart slightly from those given by equation (6''). The value "P(θ) − (o)", given here in units of radius of the array, is an indication of the aberration, and for an array of radius 40 wavelengths has the number $1.56 \times 10^{-3}$ for an aberration of λ/16. The following table gives the parameters for an improved solution. The height of the lens is denoted by $h = a - \sqrt{a^2 - b^2}$; the values a, b and h are given in units of array radius; the values of P(θ) — P(o) are in units of array radius $\times 10^{-3}$.

| | $\theta_c$ | 55° | 43° | 40° | 23° |
|---|---|---|---|---|---|
| | k | 1.00 | 0.87 | 0.83 | 0.64 |
| | a | 1.805 | 1.65 | 1.60 | 1.53 |
| | b | 1.34 | 1.11 | 1.05 | 0.73 |
| | h | 0.60 | 0.43 | 0.39 | 0.185 |
| P (θ) − P (o),θ = | 40° | 0.90 | — | 0.90 | 0.80 |
| | 45° | — | 1.10 | — | — |
| | 50° | 1.29 | 1.24 | 1.40 | 1.20 |
| | 55° | — | 1.16 | — | — |
| | 60° | 0.70 | 0.70 | 1.00 | 1.00 |
| | 68° | — | −1.37 | — | — |
| | 70° | −2.36 | −2.23 | −1.60 | −0.80 |
| | 73° | — | — | — | −1.90 |

Using the principles given above for a spherical cap geodesic lens, a ground-based antenna was designed for producing a C-band scanned beam of beamwidth 1°, over a coverage angle of ± 40°. Using k = 1, an antenna of the type described by Rinehart was found to require approximately 100 input probes in a ± 40° arc, and approximately 275 output probes connected to corresponding radiating columns extending over an arc of ± 110°. The overall diameter of this aerial was found to be 4.42m, and the total height (the height of the lens) 1.40m. The radiating columns are 1.22m in length. Applying the basis of the present invention with k = 0.82, the same aerial had the same overall radius of 4.42m (the extent of the arcuate array of radiating columns) but the height of the spherical cap was only 0.85m and the overall height of the aerial became the height of the column radiators, 1.22m. If, however, the scanning beam does not need to have a beamwidth of 1° in directions other than the boresight of the aerial, a smaller aerial can be made.

Figure 3A:
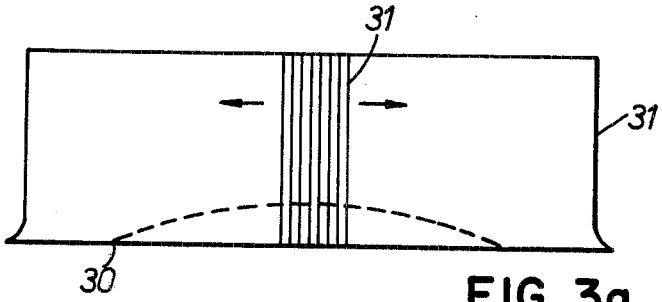
FIGS. 3*a* and 3*b* are schematic front elevation and plan views of a spherical cap geodesic lens aerial designed to produce a narrower beamwidth signal at the boresight than at the scan extremes.
Figure 3B:
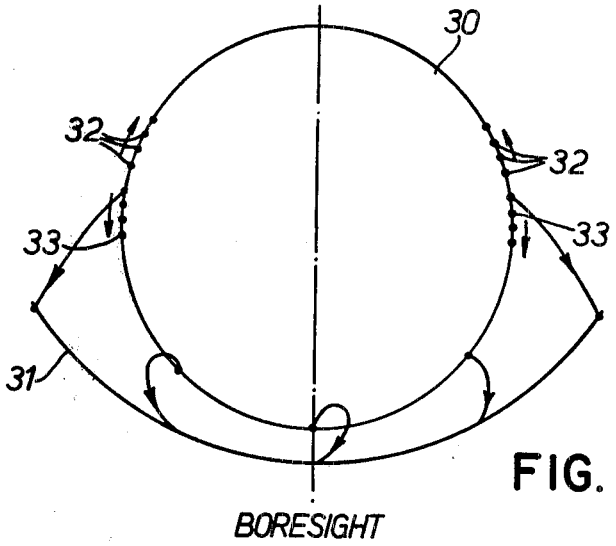

The aerial shown in FIGS. 3*a* and 3*b* provides a coverage of ± 40° with a reduced number of radiators. It has an arc of approximately 100 input probes 32 equally spaced along ± 72° of a spherical cap geodesic lens 30 and an arc of approximately 135 output probes 33 extending around the remainder of the circumference of the geodesic lens. 135 equal-length connections join the output probes 33 to respective column radiators 31, located in an arc extending for ± 54°. Although the radius of the arcuate array of radiators 31 is larger than that of the geodesic spherical cap parallel plate lens 30, the overall width of the aerial is 4.14m and the height of the spherical cap is 0.256m. This aerial has k = 0.55 and will produce a scanning planar radio beam at C-band frequencies which on boresight has a width of 1°. With this arrangement the entire array of radiating elements 31 is illuminated for radiation in the boresight direction. However, at other beam angles the array of radiators 31 is effectively foreshortened and the radiated beam is consequently broadened. At the same time, the distribution of the excitation amplitude of the radiating array becomes asymmetrical so that the side lobe level tends to increase. The side lobes, however, can be reduced to a satisfactory level by modulating the power supplied to the input probes 32 in accordance with the complex modulation technique described in the specification of Australian patent application No. 14,778/76, which corresponds to my copending U.S. application Ser. No. 694,126 entitled "Modulation of Scanning Radio Beams." In that application I have pointed out that, as the center of excitation moves away from the center line of the lens, it is desired to direct the peak energy radiated by the excited group of probes as nearly as possible towards the center of the array of radiators. This is done by applying a linear phase slope across the excited group of probes, with the phase slope increasing progressively from zero in the boresight direction to a maximum at the edge of scan. It has been found from computer simulations that a minimum number of six adjacent input probes should be excited at any instant to achieve adequate steering of the energy within the lens and thereby reduce the sidelobe level at the edge of the scan to a satisfactory level. FIG. 4 is a schematic representation of one method of achieving this objective. Power from a microwave source is split into six parts of equal amplitude and phase, each part being transmitted through an amplitude modulator and a continuously variable phase shifter, typically a four-bit digital phase shifter, to a switch which commutates the r.f. power sequentially to every sixth lens input probe. The overlapping sequence of six modulation waveforms equally-spaced in time, achieves quasi-uniform motion of the beam in space. The required form of the amplitude and phase waveforms will depend on an experimental measurement of the beam pattern in space generated when a representative sample of individual lens input probes is excited, at a number of positions around the lens input arc. Computer simulations also indicate that the optimum phase slope to be applied at any one point will best be adjusted experimentally. A relatively large amount of modulation control information must be stored within the control unit to vary the amplitude and phase continuously in the required manner, but this is well within the capabilities of present-day read-only-memories. The net result is still a broader beamwidth for beams off the boresight of the aerial, the beamwidth becoming a maximum of 1.4° at the scan extreme. Note that not only are the overall dimensions of the aerials smaller with this arrangement, but the numbers of probes, RF cables and radiating columns in the aerial are reduced.

Although only values of k which are less than 1 have been given in the examples quoted, it will be clear to those skilled in the art that transformations where k is greater than 1 are also advantageous in some instances, where large coverage angles can be obtained without diplexing, but at the expense of increased lens size.

I claim:

1. A scanning beam aerial system comprising
(a) a microwave feed system consisting of a parallel plate, geodesic lens in the shape of a spherical cap having opposed arcuate arrays of input and output probes located around the edge of the geodesic lens,
(b) a circular or arcuate array of radiating elements, and
(c) means for connecting power from said lens output probes to said radiating array by a linear angular transformation 1:k, where $k \neq 1$.

2. A scanning beam aerial system as defined in claim 1, in which $k < 1$.

3. A scanning beam aerial system as defined in claim 1, in which the entire array of radiating elements is illuminated for radiation in the boresight direction, the array illumination for radiation in other directions consequently being asymmetrical, complex modulation of the RF power supplied to input probes being used to correct the asymmetrical illumination and reduce the side lobe levels introduced by that asymmetry.

4. A scanning beam aerial system as defined in claim 1, in which the level of power supplied to the output probes of the geodesic lens is sampled using a probe centrally located on the geodesic lens.

5. A scanning beam aerial system as defined in claim 1, in which, to monitor the accuracy of the scanned beam generated by the aerial system, a sector of an annular parallel plate lens, having an inner radius substantially half the radius of the arcs of input and output probes, is loosely coupled to the edge of the geodesic lens over at least that part of the edge of the geodesic lens which contains the output probes, and means for sampling power is provided at the half-radius of said annular parallel plate lens.

6. A scanning beam aerial system as defined in claim 1, in which the space between the parallel plates of the geodesic lens is filled with a dielectric material.

7. A scanning beam aerial system as defined in claim 1, in which the radiating elements are column radiators.

* * * * *